US010547118B2

(12) United States Patent
Guntupalli et al.

(10) Patent No.: US 10,547,118 B2
(45) Date of Patent: Jan. 28, 2020

(54) DIELECTRIC RESONATOR ANTENNA ARRAYS

(71) Applicant: Huawei Technologies Co., Ltd., Shenzhen (CN)

(72) Inventors: Ajay Babu Guntupalli, Montreal (CA); Ke Wu, Montreal (CA); Tarek Djerafi, Montreal (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 474 days.

(21) Appl. No.: 14/606,715

(22) Filed: Jan. 27, 2015

(65) Prior Publication Data

US 2016/0218437 A1 Jul. 28, 2016

(51) Int. Cl.

| | |
|---|---|
| ***H01Q 19/06*** | (2006.01) |
| ***H01Q 15/08*** | (2006.01) |
| ***H01Q 9/04*** | (2006.01) |
| ***H01Q 21/06*** | (2006.01) |

(52) U.S. Cl.

CPC ..... *H01Q 19/062* (2013.01); *H01Q 9/0485* (2013.01); *H01Q 15/08* (2013.01); *H01Q 21/061* (2013.01)

(58) Field of Classification Search

CPC ..... H01Q 9/0485; H01Q 15/08; H01Q 19/062
See application file for complete search history.

(56) References Cited

U.S. PATENT DOCUMENTS 4,580,141 A * 4/1986 Gutleber ..... H01Q 21/22 343/844
5,262,790 A * 11/1993 Russo ..... H01Q 21/22 343/700 MS
5,453,754 A * 9/1995 Fray ..... H01Q 9/0485 343/700 MS (Continued)

FOREIGN PATENT DOCUMENTS

CN 101699659 4/2010
CN 102437424 A 5/2012

(Continued)

OTHER PUBLICATIONS

Petosa et al., "Dielectric Resonator Antennas: A Historical Review and the Current State of the Art", IEEE Antennas and Propagation Magazine, Oct. 2010, vol. 52, No. 5, pp. 91-116.

(Continued)

*Primary Examiner* — Dameon E Levi
*Assistant Examiner* — Ab Salam Alkassim, Jr.

(57) ABSTRACT

A dielectric resonator antenna (DRA) array having an array feeding network and a parasitic patch array made up of individual antenna elements is provided with a dielectric lens made from a single piece of dielectric material in the form of a generally planar sheet. The sheet may be substantially coextensive with the DRA array so as to cover all of the antenna elements. The single piece of dielectric material has a plurality of dielectric portions defined by a plurality of holes through the sheet. Each dielectric portion may be positioned over one of the antenna elements. Adjacent (Continued)

dielectric portions are connected to each other along connecting edge portions thereof, and a single hole is defined through the sheet between connecting edge portions of a group of mutually adjacent dielectric portions.

20 Claims, 6 Drawing Sheets

(56) References Cited

U.S. PATENT DOCUMENTS 5,706,012 A * 1/1998 Kay ..... G01S 7/2813 342/156
6,081,239 A * 6/2000 Sabet ..... H01Q 1/40 343/700 MS
6,198,449 B1 * 3/2001 Muhlhauser ..... H01Q 3/2658 343/753
6,670,930 B2 * 12/2003 Navarro ..... H01Q 21/0093 343/700 MS
6,987,591 B2 * 1/2006 Shaker ..... G01N 22/02 359/1
7,253,789 B2 8/2007 Kingsley et al.
8,780,012 B2 7/2014 Llombart Juan et al.
10,056,683 B2 * 8/2018 Sharawi ..... H01Q 3/24
2004/0108963 A1 * 6/2004 Clymer ..... H01P 1/161 343/837
2004/0174315 A1 * 9/2004 Miyata ..... H01Q 13/22 343/770
2005/0264449 A1 * 12/2005 Strickland ..... H01Q 1/288 343/700 MS
2007/0040186 A1 * 2/2007 Fillion ..... H01L 23/4821 257/177
2008/0238810 A1 * 10/2008 Winsor ..... H01Q 15/08 343/911 R
2010/0156754 A1 * 6/2010 Kondou ..... H01Q 9/0485 343/911 R
2010/0328779 A1 * 12/2010 Llombart Juan ..... H01Q 19/06 359/619
2011/0298684 A1 * 12/2011 Quan ..... H01Q 1/48 343/848
2012/0019423 A1 * 1/2012 Schultheiss ..... G01F 23/284 343/753
2012/0306713 A1 * 12/2012 Raj ..... H01Q 9/0485 343/785
2013/0021203 A1 * 1/2013 Gritz ..... H01Q 19/062 342/368
2014/0132473 A1 * 5/2014 Isom ..... H01Q 1/38 343/855
2014/0203997 A1 * 7/2014 Perricone ..... H01Q 1/28 343/912
2015/0015453 A1 * 1/2015 Puzella ..... H01Q 21/0025 343/853
2015/0236428 A1 * 8/2015 Caratelli ..... H01Q 19/062 343/755
2015/0325925 A1 * 11/2015 Kamgaing ..... H01L 23/66 343/893
2016/0036529 A1 * 2/2016 Griffith ..... H01Q 21/061 398/116
2016/0111769 A1 * 4/2016 Pance ..... H01Q 9/0492 333/202
2016/0294066 A1 * 10/2016 Djerafi ..... H01Q 13/106
2016/0294068 A1 * 10/2016 Djerafi ..... H01Q 1/38
2016/0301129 A1 * 10/2016 Ying ..... H01Q 1/523
2016/0322708 A1 * 11/2016 Tayfeh Aligodarz ..... H01P 5/12
2016/0322714 A1 * 11/2016 Ying ..... H01Q 3/24
2017/0069958 A1 * 3/2017 Ko ..... H01Q 1/243
2017/0125901 A1 * 5/2017 Sharawi ..... H01Q 3/24
2017/0271772 A1 * 9/2017 Miraftab ..... H01Q 9/0485
2019/0051989 A1 * 2/2019 Kim ..... H01Q 15/08

FOREIGN PATENT DOCUMENTS

CN 102480050 5/2012
CN 203351754 U 12/2013
EP 1976062 A1 10/2008

OTHER PUBLICATIONS

Abdel-Wahab et al., "Millimeter-Wave High Radiation Efficiency Planar Waveguide Series—Fed Dielectric Resonator Antenna (DRA) Array: Analysis, Design, and Measurements", IEEE Transactions on Antennas and Propagation, Aug. 2011, vol. 59, No. 8, pp. 2834-2843.
Svedin et al., "A Micromachined 94 GHz Dielectric Resonator Antenna for Focal Plane Array Applications," IEEE International Microwave Symposium, Honolulu, Hawaii, USA, Jun. 2007, pp. 1375-1378.
Zhang et al., "Analysis of Dielectric Resonator Antenna Arrays with Supporting Perforated Rods," EuCAP 2007, Edinburgh, Scotland, Nov. 2007, pp. 1-5.
Buerkle et al., "Fabrication of a DRA Array Using Ceramic Stereolithography", IEEE Antennas and Wireless Propagation Letters, Sep. 2006, vol. 5, pp. 479-482.
Petosa et al., "Comparison Between Planar Arrays of Perforated DRAs and Microstrip Patches," IEEE International Symposium on Antennas and Propagation, Washington, DC, 2b, Jul. 2005 , pp. 168-171.
Keller et al., "A Ka-Band Dielectric Resonator Antenna Reflectarray," European Microwave Conference 2000, Paris, France, Oct. 2000, pp. 272-275.
International Search Report and Written Opinion of corresponding International Appl. No. PCT/CN2015/098450 dated Mar. 18, 2016.
Translation of Abstract of cited Chinese reference 102480050A; Shenzhen Kuang Chi INST. et al.; May 30, 2012.
Partial translation of specification of Chinese reference 102480050A; Shenzhen Kuang Chi INST. et al.; May 30, 2012.
Translation of Abstract of cited Chinese reference 101699659A; Univ. Southeast; Apr. 28, 2010.
Partial translation of specification of Chinese reference 101699659A; Univ. Southeast; Apr. 28, 2010.
XP11538757A. Yujian Li et al. A 60-GHz Dense Dielectric Patch Antenna Array, Ieeetransactions Onantennas Andpropagation, vol. 62, No. 2, Feb. 2014. pp. 960-963.
XP010858240. Petosa A et al: "Comparisonbetween planar arrays of perforated ORAs and microstrippatches", Antennas ANO Propagation Societysymposium, IEEE, Jul. 3, 2005. pp. 168-175.
XP006019364. Petosa A et al: "Perforated dielectric resonator antennas", Electronics LET, IEE Stevenage, GB,vol. 38, No. 24, Nov. 21, 2002. pp. 1493-1495.
XP001225500. Essellekp et al: "Hybrid-Resonator Antenna: Experimental Results",IEEE Transactions on Antennas and Propagation,vol. 53, No. 2, Feb. 2005. p. 870-871.

* cited by examiner

DIELECTRIC RESONATOR ANTENNA ARRAYS

FIELD

The present disclosure relates generally to a design for a lens element, and in a particular embodiment, to a dielectric lens element for a dielectric resonator antenna (DRA) arrays.

BACKGROUND

Millimeter-wave frequency bands utilizing frequencies around 60 GHz can be employed to realize the next-generation wireless short-haul high-speed microwave communication links between wireless devices. Millimeter-wave antenna arrays needs to satisfy the link budget requirement. The path loss can be compensated by using high gain antenna arrays for transmitting and receiving electromagnetic signals. The antenna elements such arrays should initially achieve acceptable gain. Various methods have been proposed to increase antenna element gain, including the use of a dielectric resonating element attached on each antenna element. Examples of some dielectric resonator antenna (DRA) arrays according to the prior art are disclosed in Petosa, A.; Ittipiboon, A. "Dielectric Resonator Antennas: A Historical Review and the Current State of the Art", *Antennas and Propagation Magazine*, IEEE, pages 91-116, Volume: 52, Issue: 5, October 2010.

SUMMARY

In one aspect, the present disclosure provides a dielectric lens for a dielectric resonator antenna (DRA) array having a plurality of antenna elements. The dielectric lens comprises a single piece of dielectric material in the form of a generally planar sheet. The sheet is substantially coextensive with the DRA array so as to cover all of antenna elements. The single piece of dielectric material comprises a plurality of dielectric portions defined by a plurality of holes through the sheet. Each dielectric portion is positioned over one of the antenna elements. Adjacent dielectric portions are connected to each other along connecting edge portions thereof. A single hole is defined through the sheet between connecting edge portions of a group of mutually adjacent dielectric portions.

In another aspect, the present disclosure provides a dielectric resonator antenna (DRA) array having an array feeding network, a parasitic patch array with a plurality of antenna elements, and a dielectric lens made from a single piece of dielectric material in the form of a generally planar sheet. The sheet is substantially coextensive with the DRA array so as to cover all of the plurality of antenna elements. The single piece of dielectric material comprises a plurality of dielectric portions defined by a plurality of holes through the sheet. Each dielectric portion is positioned over one of the antenna elements. Adjacent dielectric portions are connected to each other along connecting edge portions thereof. A single hole is defined through the sheet between connecting edge portions of a group of mutually adjacent dielectric portions.

The plurality of antenna elements and the plurality of dielectric portions may be arranged in rectangular arrays, with each rectangular array forming a grid of generally perpendicular rows and columns. The plurality of antenna elements may be arranged in a plurality of 2×2 sub arrays, and the plurality of dielectric elements may be arranged in a plurality of sub groups corresponding to the plurality of 2×2 sub arrays.

The holes may comprise a plurality of first holes, a plurality of second holes larger than the first holes, and a plurality of third holes larger than the second holes. Each first hole may be positioned between four dielectric elements of a single sub group, each second hole may be positioned between four dielectric elements from two different sub groups, and each third hole may be positioned between four dielectric elements from four different sub groups.

In another aspect, the present disclosure provides a method for producing a dielectric lens for a dielectric resonator antenna (DRA) array. The method comprises providing a single piece of dielectric material in the form of a generally planar sheet, the sheet being substantially coextensive with the DRA array so as to cover all of the plurality of antenna elements, determining locations for a plurality of holes through the sheet based on locations of the plurality of antenna elements, and forming the plurality of holes through the sheet to define a plurality of dielectric portions, each dielectric portion being configured to be positioned over one of the plurality of antenna elements.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

DETAILED DESCRIPTION

Generally, the present disclosure is directed to a dielectric lens for use in a dielectric resonator array. In some disclosed embodiments, the lens is in the form of a single dielectric sheet of dielectric material for a dielectric resonator antenna (DRA) array. The sheet has a plurality of dielectric elements defined by a plurality of holes through the sheet.

Figure 1:
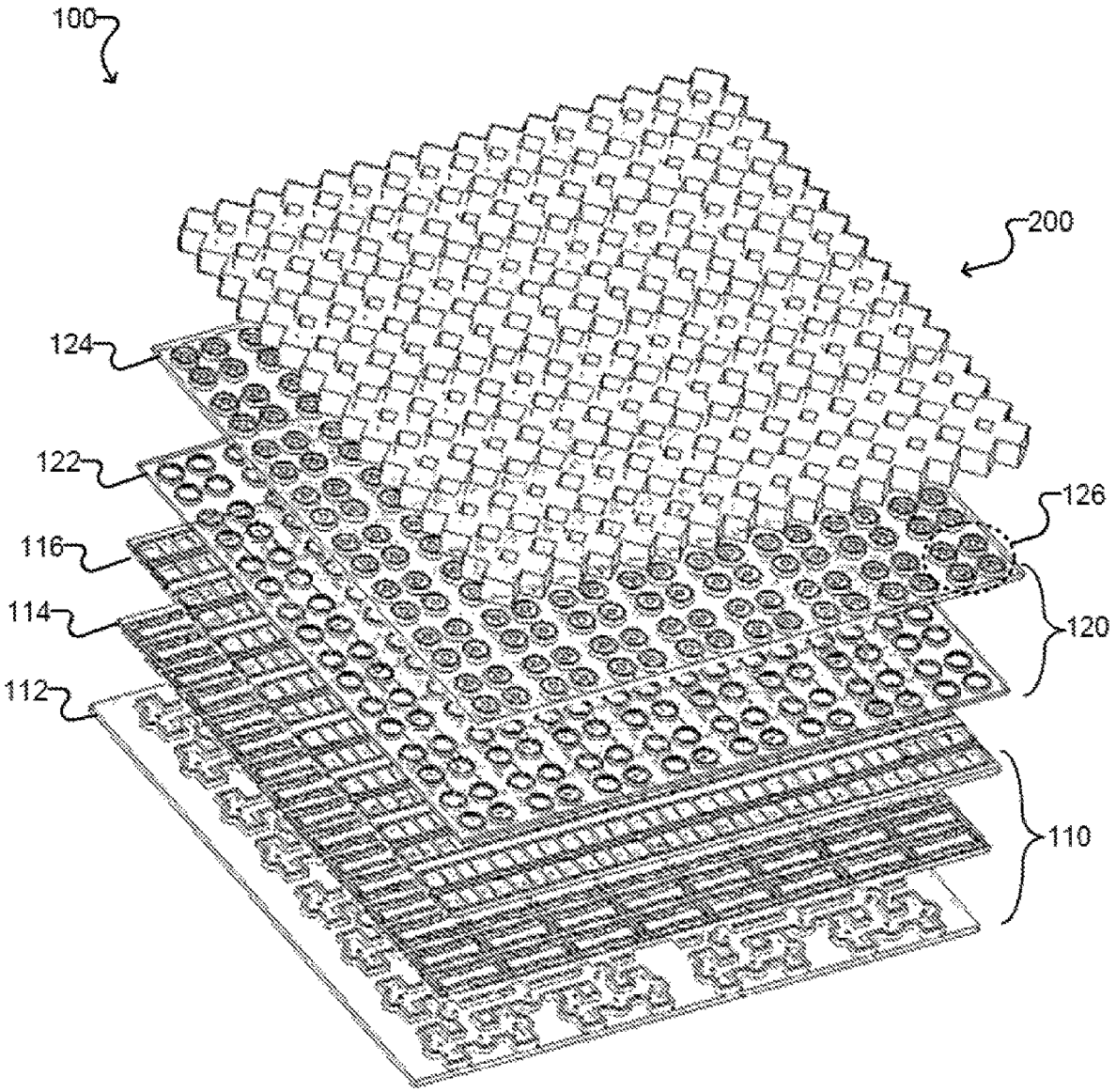
FIG. 1 is an exploded perspective view an example dielectric resonator antenna (DRA) array according to one embodiment

FIG. 1 shows an example of a DRA array 100 according to one embodiment. The DRA array comprises an array feeding network 110, a parasitic patch array 120, and a dielectric lens in the form of a single dielectric sheet 200, which is described in further detail below. In the illustrated example, the array feeding network 110 comprises three layers 112, 114, 116 configured to provide signals to and receive signals from the parasitic patch array 120. The parasitic patch array 120 comprises first and second layers 122, 124, each comprising a plurality of antenna elements (not enumerated). In the illustrated example, the antenna elements of the parasitic patch array 120 are arranged into a plurality of sub arrays 126 of four individual antenna elements in a 2×2 rectangular grid, and the spacing between adjacent antenna elements within each sub array 126 is smaller than the spacing between adjacent antenna elements from different sub arrays 126. In some embodiments, the DRA array is configured to operate in a frequency bandwidth of about 57-66 GHz.

Figure 2:
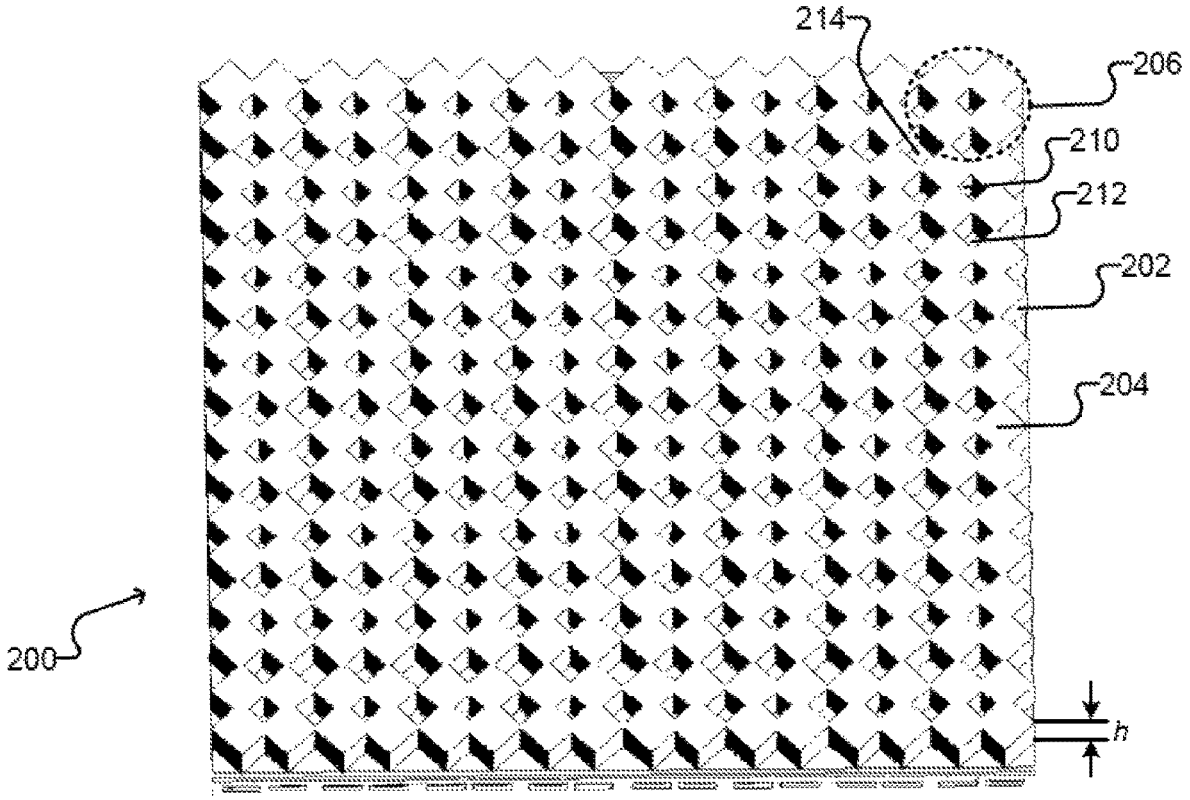
FIG. 2 is a perspective view of the dielectric sheet of the example DRA array of FIG. 1.
Figure 4:
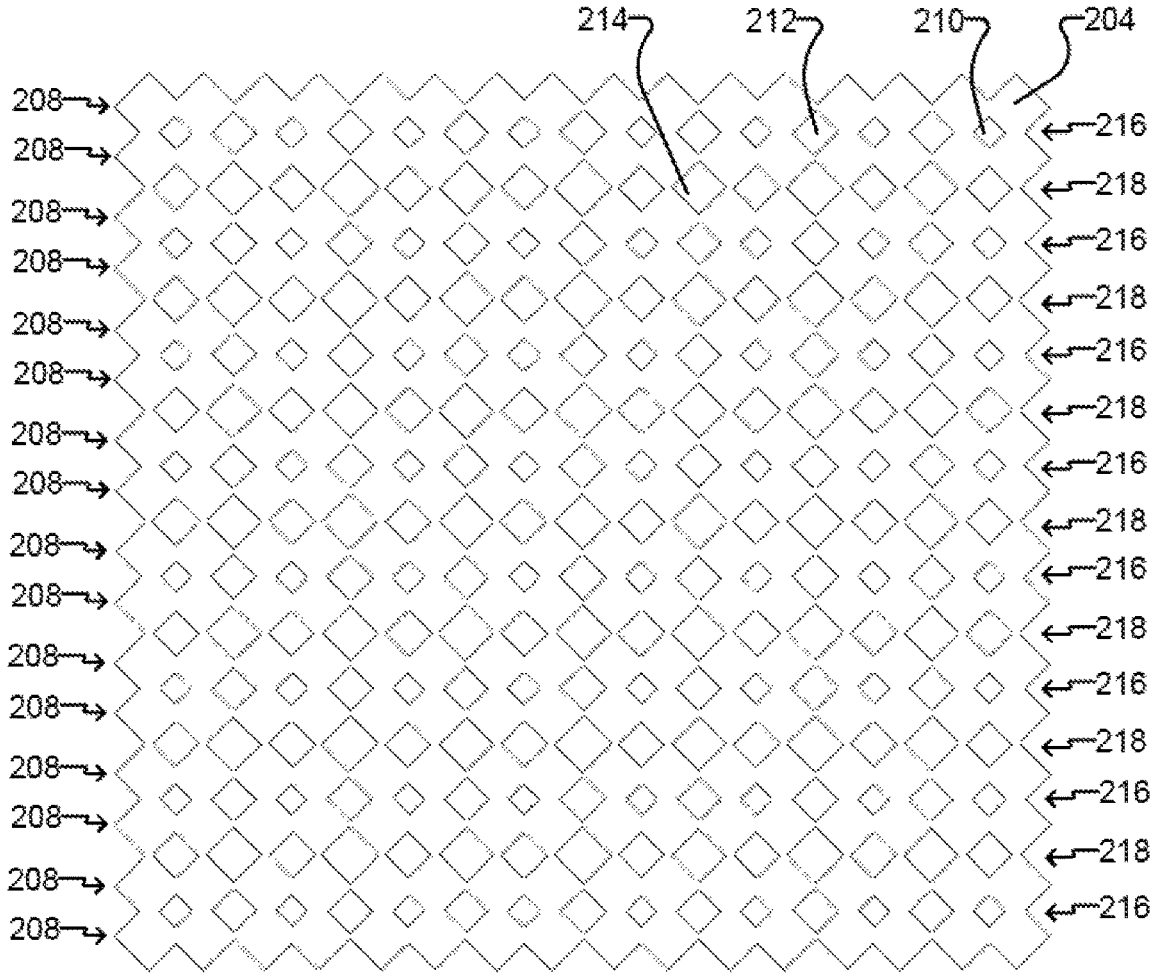
FIG. 4 is a top plan view of the dielectric sheet of the example DRA array of FIG. 1.

As shown in FIGS. 2 and 4, the sheet 200 of FIG. 1 comprises a single piece 202 of dielectric material that is generally planar and has a substantially uniform height h (also referred to as a thickness). In some embodiments, the piece of dielectric material has a height h that is selected based on a signal wavelength A of the DRA array 100. In some embodiments, the piece of dielectric material has a height h in the range of 0.5λ to 0.6λ. In some embodiments, the piece of dielectric material has a height h in the range of 100-120 mils. In some embodiments, the dielectric material has a dielectric constant in the range of 2 to 10, depending on the dielectric constant of the array feeding network 110.

Figure 3:
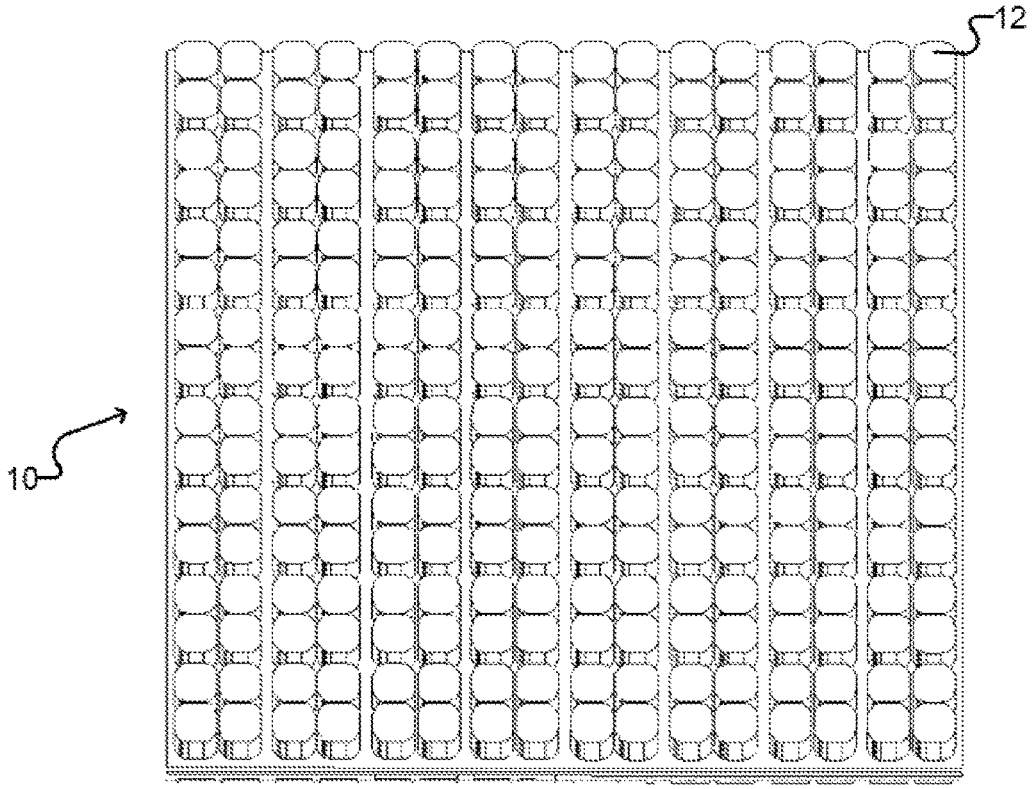
FIG. 3 (PRIOR ART)
FIG. 3 is a perspective view of an example prior art array of individual dielectric elements.

The single piece 202 of dielectric material comprises a plurality of dielectric portions 204 defined by a plurality of holes 210, 212, 214 through the sheet 200. Each dielectric portion 204 is configured to be positioned over one of the antenna elements of the parasitic patch array 120. By way of contrast, FIG. 3 shows an example prior art array 10 of individual dielectric elements 12. Each dielectric element 12 must be individually positioned and mounted atop a corresponding antenna element. The sheet 200 of FIG. 2 advantageously eliminates the need for individual alignment of dielectric elements, since only the single piece 202 needs to be aligned with the parasitic patch array 120.

The dielectric portions 204 are each connected to adjacent dielectric portions 204 by connecting edge portions. In the illustrated example, the dielectric portions 204 are generally rhombus-shaped (e.g. squares), with the connecting edge portions comprising corner portions of each square. A single hole 210/212/214 is defined between connecting edge portions of a group of mutually adjacent dielectric portions 204. The term "mutually adjacent dielectric portions" is used herein to refer to a group of dielectric portions 204 that are all either horizontally, vertically or diagonally (with reference to the orientation illustrated in FIGS. 2 and 4) adjacent to one another, and which surround a single hole 210/212/214. In some embodiments, such as for example embodiments wherein the underlying antenna elements are all evenly spaced, all of the holes may be the same size. In other embodiments, such as for example the embodiment shown in FIGS. 2 and 4, the holes 210/212/214 may have different sizes, as discussed below.

In the illustrated example, the dielectric portions 204 are arranged in sub groups 206, with each sub group 206 configured to be positioned over a corresponding sub array 126 of the parasitic patch array 120. The connecting edge portions between adjacent dielectric portions 204 within a sub group 206 are more extensive than the connecting edge portions between adjacent dielectric portions 204 from adjacent sub groups 206, due to the difference in spacing between the underlying antenna elements. As a consequence, in the illustrated example, each of the holes 210 within a sub group 206 is smaller than each of the holes 212 between horizontally or vertically (with reference to the orientation illustrated in FIGS. 2 and 4) adjacent sub groups 206. Similarly, each of the holes 212 between horizontally or vertically (with reference to the orientation illustrated in FIGS. 2 and 4) adjacent sub groups 206 is smaller than each of the holes 214 between diagonally (with reference to the orientation illustrated in FIGS. 2 and 4) adjacent sub groups 206.

With reference to FIG. 4, in the illustrated embodiment the dielectric portions 204 are arranged in a rectangular array comprising a grid of generally perpendicular rows 208 and columns (not enumerated). The holes 210, 212, 214 are also arranged in a complementary grid, with alternating types of rows 216/218 and columns (not enumerated). The rows 216 that pass through sub groups 206 comprise alternating ones of holes 210 and 212, and the rows 218 that pass between adjacent sub groups 216 comprise alternating ones of holes 212 and 214.

Figure 5:
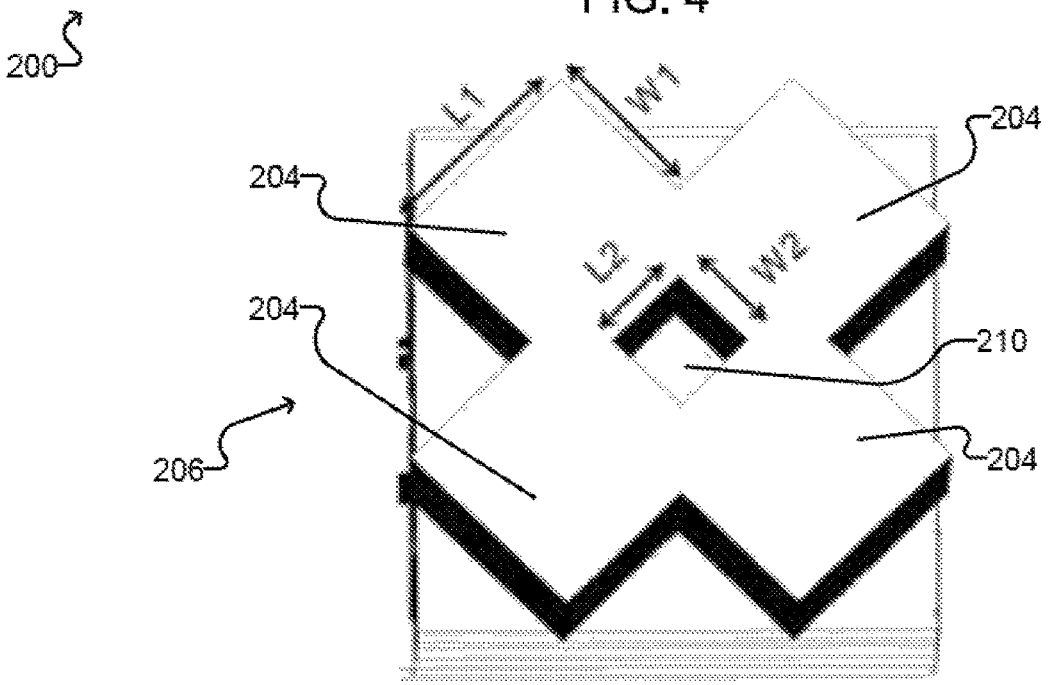
FIG. 5 is a perspective view of an example dielectric sheet for a 2×2 sub array of the example DRA array of FIG. 1.

FIG. 5 shows an example sub group 216 in isolation. Each dielectric portion 204 of the sub group 206 is generally square-shaped, with each of the sides of the square having a length L1. The corner portions of each dielectric portion 204 overlap with the horizontally and vertically adjacent dielectric portions 204 to form connecting edge portions. The distance from the outer side of one dielectric portion 204 to the location at which the corner portion overlaps with an adjacent dielectric portion 204 is W1, which is less than L1. The hole 210 in the center of the sub group has sides of length L2 and W2. In some embodiments the hold 210 is square and L2=W2.

Experimental results obtained with a single dielectric sheet comprising an array of 16×16 dielectric portions similar to the examples illustrated in FIGS. 2 and 4 indicate a peak gain of 3 dB with a bandwidth of 14.7% at 61 GHz. With reference to the dimensions shown in FIG. 5, in the experimental embodiment, L1=3.6 mm; W1=2.89 mm and L2=W2=1.58 mm. In the experimental embodiment, the sheet had a height h of 120 mils and the material had a dielectric constant of 2.94. The effective dielectric constant is reduced once the holes 210/212/214 are formed.

The examples discussed above contemplate generally square-shaped dielectric portions 204 and holes 210/212/214. However, it is to be understood that different sizes and shapes of the dielectric portions and holes may be utilized in other embodiments. Some examples of differently shaped dielectric portions and holes are discussed below with reference to FIGS. 7-10.

The sizes of the holes 210/212/214 may be selected based on the sizes of the dielectric portions. In some embodiments, each hole is has a minimum dimension of at least one half of the minimum dimension of the dielectric portions. In some embodiments, each hole through the sheet of dielectric material has a minimum dimension in the range of 0.5-2 mm. The term "minimum dimension", as used herein means the shortest distance from one side of the dielectric portion or hole, through the center of the dielectric portion or hole, to an opposed side of the dielectric portion or hole. For example, for a square hole, the minimum dimension is the length of one of the sides of the square. For a rectangular hole, the minimum dimension is the length of one of the shorter sides of the rectangle. For a circular hole, the minimum dimension is the diameter of the circle. As discussed above and illustrated in the Figures, holes 210/212/214 can have different sizes. Holes 210/212/214 can also have different shapes.

Figure 6:
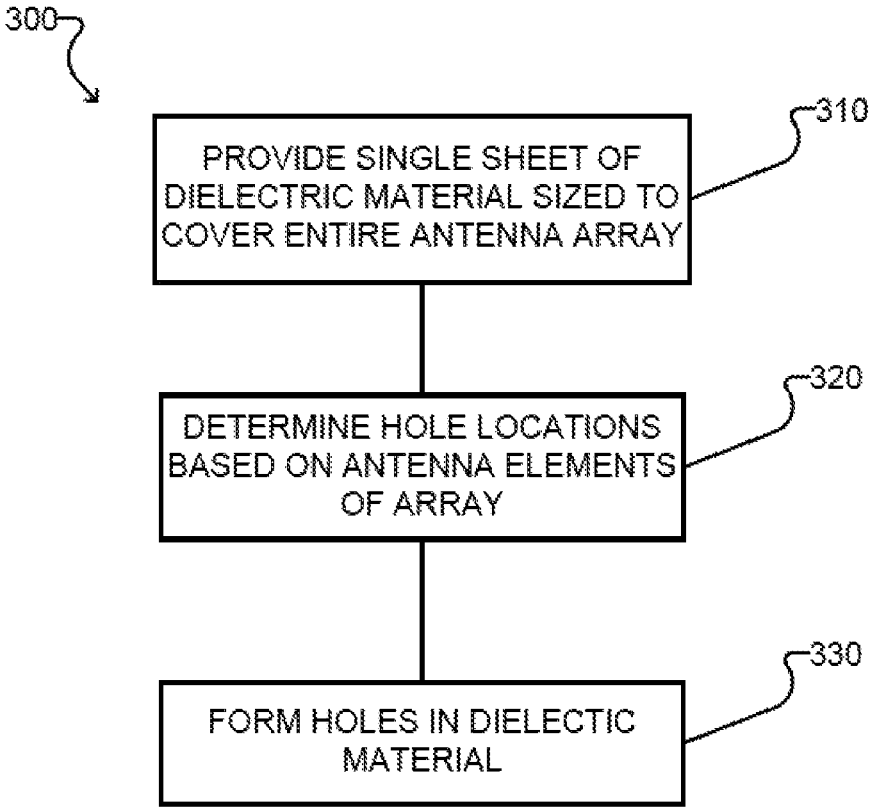
FIG. 6 is a flowchart illustrating steps of an example method of forming a dielectric sheet for a DRA array according to one embodiment.

FIG. 6 is a flowchart illustrating steps of an example method 300 for producing a dielectric lens for a DRA array according to one embodiment. At 310 a single piece of dielectric material in the form of a generally planar sheet is provided. The sheet may be substantially coextensive with the DRA array such that the sheet is large enough to cover all of the plurality of antenna elements.

At 320 locations for a plurality of holes through the sheet of dielectric material are determined. The locations may be determined based on locations of the plurality of antenna elements of the DRA array. For each determined hole location, a hole size and hole shape may also be determined. As noted above, in some embodiments the holes may all have the same size, and in other embodiments the holes may have different sizes, depending on whether or not the antenna element are regularly spaced or arranged into sub arrays.

At 330 the holes are formed through the sheet of dielectric material. In some embodiments, forming the holes may comprise drilling through the sheet of dielectric material with a high-powered laser. Depending on the type of laser used and the thickness of the sheet, the high-powered laser may make multiple passes to drill a single hole through the sheet of dielectric material. In some embodiments, forming the holes may comprise cutting through the sheet of dielectric material with a water jet cutter. The edges of the sheet may also be shaped to conform to the pattern of holes and dielectric portions, either when the sheet is provided or when the holes are formed. In some embodiments, forming the sheet and holes may comprise defining a mask based on determined locations, sizes and shapes for the holes, and forming the sheet using a 3D printing technique.

Figure 7:
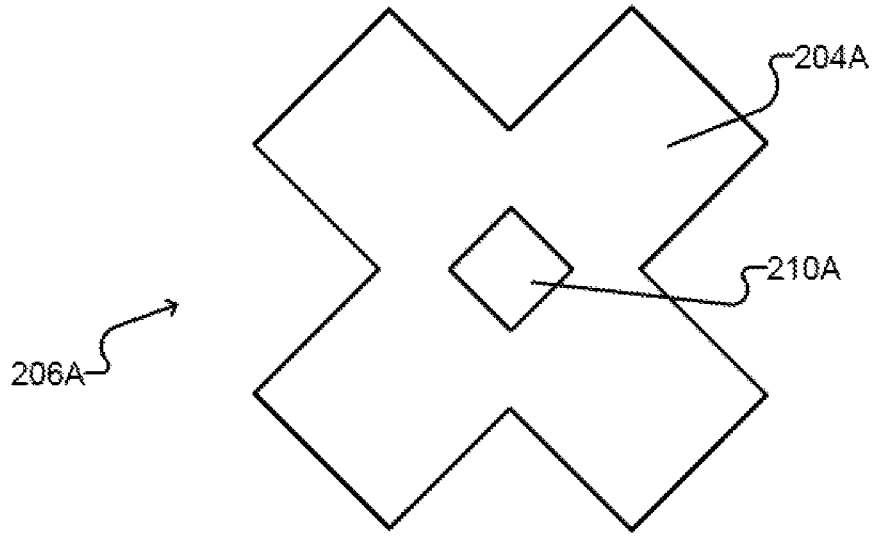
FIG. 7 is a top plan view of an example dielectric sheet for a DRA array according to another embodiment.
Figure 8:
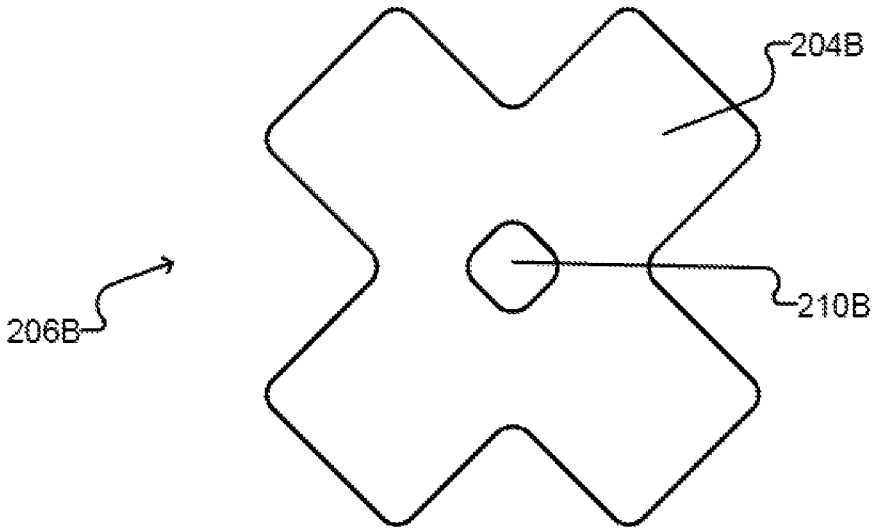
FIG. 8 is a top plan view of an example dielectric sheet for a DRA array according to another embodiment.
Figure 9:
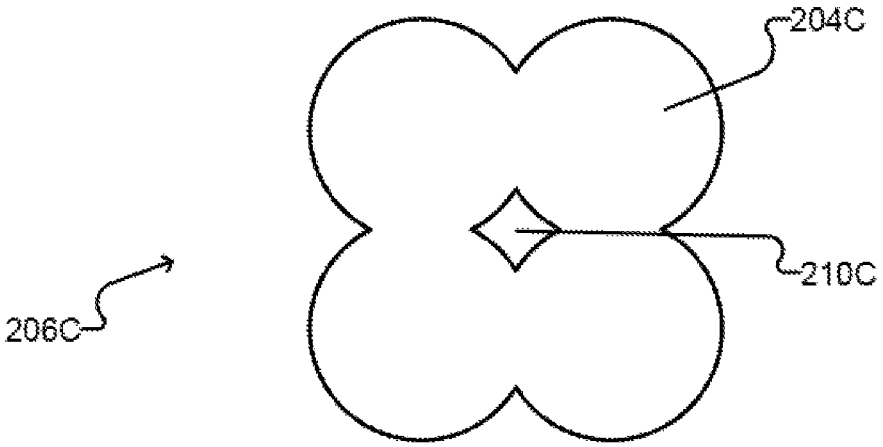
FIG. 9 is a top plan view of an example dielectric sheet for a DRA array according to another embodiment.

FIG. 7 shows an example 2×2 sub group 206A of a dielectric lens according another embodiment. In the FIG. 7 embodiment, each dielectric portion 204A is generally rectangle-shaped, and the hole 210A within the sub group 206A is generally square-shaped. FIG. 8 shows an example 2×2 sub group 206B of a dielectric lens according another embodiment. In the FIG. 8 embodiment, each dielectric portion 204B is generally rounded-rectangle-shaped (i.e., a rectangle with rounded corners), and the hole 210B within the sub group 206B is generally rounded-square-shaped. FIG. 9 shows an example 2×2 sub group 206C of a dielectric lens according another embodiment. In the FIG. 9 embodiment, each dielectric portion 204C is generally circle-shaped, and the hole 210C within the sub group 206C is generally pseudo-square-shaped with inwardly arced sides. Other shapes are also possible for the dielectric portions. As discussed above and illustrated in the Figures, holes 2101A-C/212A-C/214A-C can have different sizes. Holes 210A-C/212A-C/214A-C can also have different shapes.

Figure 10:
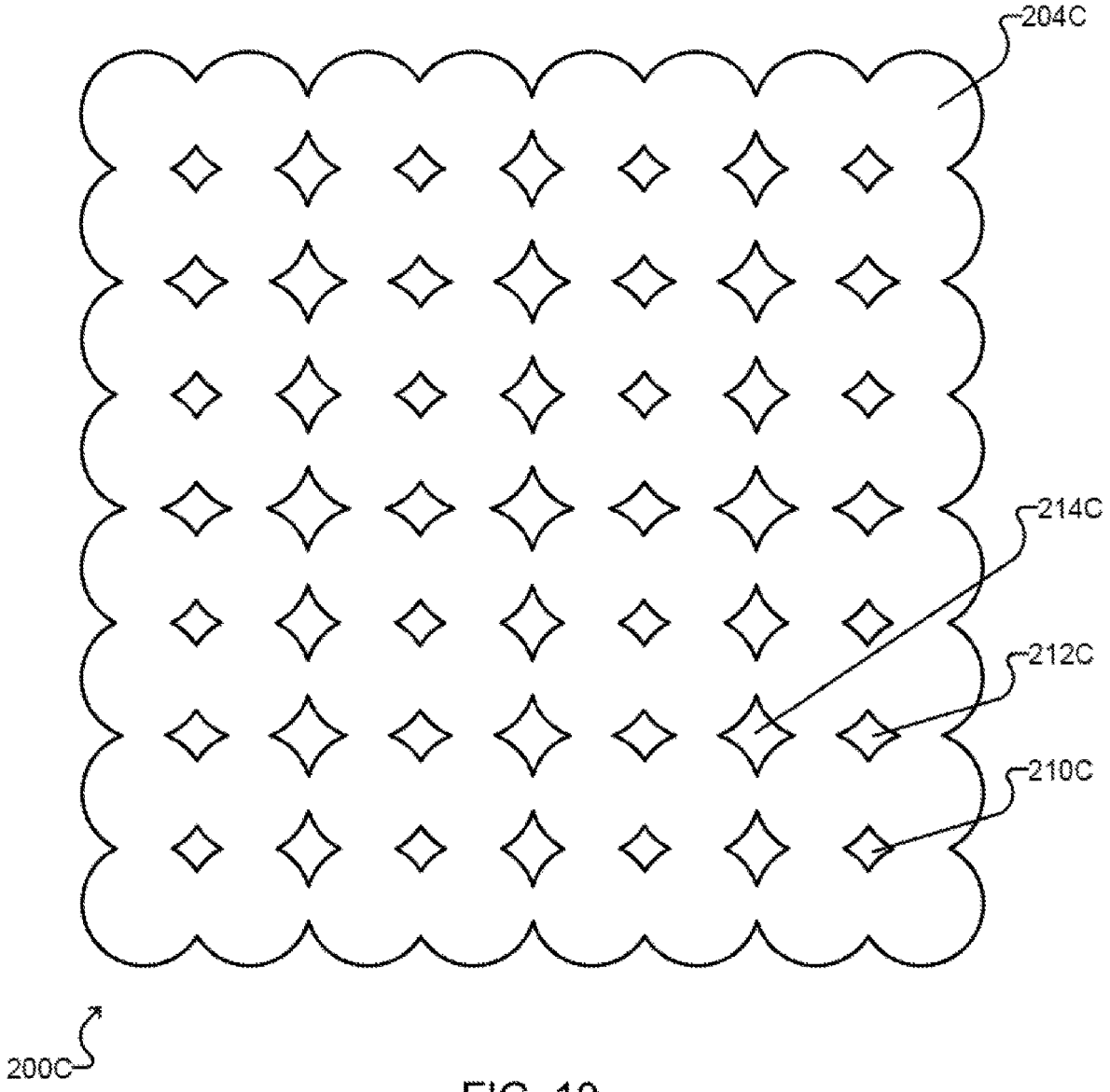
FIG. 10 is a top plan view of an example dielectric sheet for a DRA array according to another embodiment.

Any of the sub groups 206A-C shown in FIGS. 7-9 may be used to form larger a dielectric lens. For example, FIG. 10 shows a dielectric lens in the form of a single dielectric sheet 200C, comprising an 8×8 array of circular dielectric portions 204C arranged in sub groups of the type shown in FIG. 9. Similar to the embodiment of FIGS. 2 and 4, each of the holes 210C within a sub group 206C is smaller than each of the holes 212C between horizontally or vertically (with reference to the orientation illustrated in FIG. 10) adjacent sub groups 206C. Similarly, each of the holes 212C between horizontally or vertically (with reference to the orientation illustrated in FIG. 10) adjacent sub groups 206C is smaller than each of the holes 214C between diagonally (with reference to the orientation illustrated in FIG. 10) adjacent sub groups 206C.

In the examples discussed above, a dielectric lens is provided in the form of a single sheet sized to cover all of the antenna elements of a DRA array. In other embodiments, more than one dielectric sheet may be used to cover the DRA array, for example by providing a dielectric lens in the form two sheets, with one sheet sized to cover a first plurality of antenna elements and the other sheet sized to cover a second plurality of antenna elements. As one skilled in the art will appreciate, more than two sheets may also be provided in some embodiments.

In the preceding description, for purposes of explanation, numerous details are set forth in order to provide a thorough understanding of the embodiments. However, it will be apparent to one skilled in the art that these specific details are not required. In other instances, well-known electrical structures and circuits are shown schematically in order not to obscure the understanding. For example, specific details are not provided as to the particular construction and mode of operation of the array feeding network 110 and the parasitic patch array 120.

The above-described embodiments are intended to be examples only.

Alterations, modifications and variations can be effected to the particular embodiments by those of skill in the art. The scope of the claims should not be limited by the particular embodiments set forth herein, but should be construed in a manner consistent with the specification as a whole.

What is claimed is:

1. A dielectric lens comprising:

a single layer of dielectric material in the form of a generally planar sheet, the sheet being sized to cover a parasitic patch array fed by an array feeding network, the parasitic patch array including a first layer comprising a plurality of first antenna elements and a second layer comprising a plurality of second antenna elements, each second antenna element being aligned with a respective first antenna element;

wherein the single layer of dielectric material comprises a plurality of dielectric portions, each defined by a plurality of holes through the sheet, each dielectric portion being configured to be positioned over a corresponding aligned second antenna element and first antenna element to form a dielectric resonator antenna (DRA) array, and wherein adjacent dielectric portions are connected to each other along connecting edge portions thereof, and a single hole is defined through the sheet between connecting edge portions of a group of mutually adjacent dielectric portions.

2. The dielectric lens of claim 1 wherein the plurality of dielectric portions are arranged in a rectangular array comprising a grid of generally perpendicular rows and columns.

3. The dielectric lens of claim 2 wherein the single hole is defined between each group of four dielectric portions.

4. The dielectric lens of claim 3 wherein each dielectric portion is generally rhombus-shaped.

5. The dielectric lens of claim 1 wherein each dielectric portion is generally square-shaped and each of the single holes is generally square-shaped, with sides of each hole oriented at an angle of about 45 degrees to the rows and columns of the grid.

6. The dielectric lens of claim 5 wherein the sides of each of the single holes has a length in the range of about 0.5-2 mm.

7. The dielectric lens of claim 1 wherein each dielectric portion is generally rhombus-shaped.

8. The dielectric lens of claim 1 wherein each dielectric portion is generally square-shaped.

9. The dielectric lens of claim 1 wherein each dielectric portion is generally rectangle-shaped.

10. The dielectric lens of claim 1 wherein each dielectric portion is generally circle-shaped.

11. The dielectric lens of claim 1 wherein each hole has a minimum dimension in the range of 0.5-2 mm, wherein the minimum dimension is the shortest distance from one side of the hole, through the center of the hole, to an opposed side of the hole.

12. The dielectric lens of claim 1 wherein the sheet has a thickness in the range of about 0.5λ to 0.6λ, where λ is a signal wavelength of a DRA array into which the dielectric lens is integrated.

13. The dielectric lens of claim 1 where the dielectric material has a dielectric constant in the range of about 2-10.

14. A dielectric resonator antenna (DRA) array comprising:

an array feeding network being configured to provide signals to and receive signals from a parasitic patch array;

the parasitic patch array comprising a first layer comprising a plurality of first antenna elements and a second layer comprising a plurality of second antenna elements, each second antenna element being aligned with a respective first antenna element; and a dielectric lens comprising:

a single layer of dielectric material in the form of a generally planar sheet, the sheet being of a substantially similar size to the first and second layers of the parasitic patch array so as to cover all of the plurality of second antenna elements;

wherein the single piece of dielectric material comprises a plurality of dielectric portions, each dielectric portion defined by a plurality of holes through the sheet, each dielectric portion being configured to be positioned over a corresponding aligned second antenna element and first antenna element to form the DRA array, and wherein adjacent dielectric portions are connected to each other along connecting edge portions thereof, and a single hole is defined through the sheet between connecting edge portions of a group of mutually adjacent dielectric portions.

15. The DRA array of claim 14 wherein the plurality of antenna elements and the plurality of dielectric portions are arranged in rectangular arrays, each rectangular array comprising a grid of generally perpendicular rows and columns.

16. The DRA array of claim 15 wherein the plurality of first and second antenna elements on each layer are arranged in a plurality of 2×2 sub-arrays, and wherein the plurality of dielectric portions are arranged in a plurality of sub groups corresponding to the plurality of 2×2 sub-arrays.

17. The DRA array of claim 16 wherein the plurality of holes comprise a plurality of first holes, a plurality of second holes larger than the first holes, and a plurality of third holes larger than the second holes, wherein each first hole is positioned between four dielectric elements of a single sub group, each second hole is positioned between four dielectric elements from two different sub groups, and each third hole is positioned between four dielectric elements from four different sub groups.

18. A method for producing a dielectric lens for a dielectric resonator antenna (DRA) array, the method comprising:

providing a single layer of dielectric material in the form of a generally planar sheet, the sheet being of a substantially similar size to a parasitic patch array so as to cover the parasitic patch array fed by an array feeding network, wherein the parasitic patch array including first layer comprising a plurality of first antenna elements and a second layer comprising a plurality of second antenna elements that is disposed on the first layer, each second antenna element being aligned with a respective first antenna element;

determining locations for a plurality of holes through the sheet based on locations of the plurality of second antenna elements; and forming the plurality of holes through the sheet to define a plurality of dielectric portions that are each configured to be positioned over a corresponding one of the plurality of second antenna elements and its aligned first antenna element to form the DRA array.

19. The method of claim 18 wherein forming the plurality of holes comprises drilling through the single piece of dielectric material with a laser.

20. The method of claim 18 wherein forming the plurality of holes comprises cutting through the single piece of dielectric material with a water jet.

* * * * *